US010900218B2

(12) United States Patent
Houston et al.

(10) Patent No.: US 10,900,218 B2
(45) **Date of Patent: *Jan. 26, 2021**

(54) METHOD AND APPARATUS FOR FABRICATING A FLOOR PLATE FOR A BUILDING

(71) Applicant: BIG TIME INVESTMENT, LLC, Southfield, MI (US)

(72) Inventors: Stephen T. Houston, Lake Orion, MI (US); Joseph Michael Benvenuto, Monroe, MI (US); Aleksei Ivanikiw, Lake Orion, MI (US)

(73) Assignee: Big Time Investment, LLC, Southfield, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/393,468

(22) Filed: Apr. 24, 2019

(65) Prior Publication Data

US 2020/0340234 A1 Oct. 29, 2020

(51) Int. Cl.
*E04B 1/35* (2006.01)
*E04B 5/14* (2006.01)

(52) U.S. Cl.
CPC ..... *E04B 1/3516* (2013.01); *E04B 5/14* (2013.01)

(58) Field of Classification Search
CPC ..... E04B 1/3516; E04B 1/4114; E04B 1/14; E04B 1/16
See application file for complete search history.

(56) References Cited

U.S. PATENT DOCUMENTS 2,732,177 A 1/1956 Ludowici
3,070,845 A * 1/1963 Cheskin ..... E04C 3/40 52/223.11
3,283,465 A 11/1966 Cheskin
3,721,056 A * 3/1973 Toan ..... E04B 1/20 52/236.6
3,971,179 A * 7/1976 Bodocsi ..... E04B 1/24 52/223.11
3,978,630 A 9/1976 Labie et al.
(Continued)

FOREIGN PATENT DOCUMENTS

JP 4048007 B2 2/2008

OTHER PUBLICATIONS

International search report for international application No. PCT/US2020/027778 dated Jun. 25.

*Primary Examiner* — Beth A Stephan
(74) *Attorney, Agent, or Firm* — Quinn IP Law

(57) ABSTRACT

Fabrication of a multi-story building includes fabricating floor plates at or near ground level, and lifting them to a final position on a vertical support core. A method for assembling one of the floor plates assembling a floor plate frame near ground level. Cambers are imparted into framing members based upon expected deflections, and metal decking is installed onto the floor plate frame. A plurality of permanent support points for the floor plate are determined, wherein the floor plate is attachable to the vertical support core at the permanent support points. First pedestals are installed between ground level and the floor plate frame proximal to the permanent support points for the floor plate. Hardenable material is dispersed onto the metal decking of the floor plate frame while the floor plate frame is lifted at the permanent support points.

21 Claims, 5 Drawing Sheets

(56) References Cited

U.S. PATENT DOCUMENTS

| | | | | | |
|---|---|---|---|---|---|
| 3,981,109 | A * | 9/1976 | Termohlen | E04B 1/3404 | 52/125.1 |
| 4,071,988 | A * | 2/1978 | Bowes | E04B 1/3511 | 52/127.1 |
| 4,709,456 | A | 12/1987 | Iyer | | |
| 5,074,095 | A | 12/1991 | Wilnau | | |
| 5,469,684 | A * | 11/1995 | Franklin | E04B 1/3516 | 264/33 |
| 7,581,709 | B2 * | 9/2009 | Gillespie | E04G 11/38 | 249/19 |
| 7,640,702 | B2 * | 1/2010 | Termohlen | E04B 5/43 | 52/220.3 |
| 7,784,231 | B2 | 8/2010 | Termohlen | | |
| 8,806,820 | B2 | 8/2014 | Ahn | | |
| 9,752,316 | B2 | 9/2017 | Thornton | | |
| 2003/0089050 | A1 * | 5/2003 | Tipping | E04G 25/06 | 52/127.2 |
| 2004/0037653 | A1 * | 2/2004 | Kelso | E02D 35/00 | 405/236 |
| 2008/0276550 | A1 * | 11/2008 | Termohlen | E04B 1/3516 | 52/169.9 |
| 2009/0049762 | A1 | 2/2009 | Termohlen | | |

* cited by examiner

METHOD AND APPARATUS FOR FABRICATING A FLOOR PLATE FOR A BUILDING

TECHNICAL FIELD

The disclosure generally relates to a method of constructing a building, and a vertical slip form construction system therefor.

BACKGROUND

Many methods of constructing multi-story buildings exist. Traditionally, multi-story buildings have been constructed from the ground up, in which construction of the building begins on a ground level by attaching higher elevation structural elements on top of previously assembled lower structural elements to construct the building in upward direction, i.e., from bottom up. This construction method requires that the structural elements be lifted by a crane and connected in situ at elevation.

Known methods for constructing high-rise buildings may be inefficient. Presently, structural framing elements may be assembled into a building frame one member at a time, well above ground level. Tower cranes may be used to facilitate construction, which may include executing thousands of individual lifts for each element of the structure, building enclosure, finishes, mechanical and electrical equipment and many other components of a finished building. Furthermore, concrete or another hardenable material is pumped to the final elevation of each floor. These operations may require specialized equipment and setup logistics, and may be time-consuming and costly when constructing tall buildings.

SUMMARY

A multi-story building that includes a vertical support core and a plurality of floor plates is described, wherein fabrication of the building includes fabricating each of the floor plates at or near ground level, and lifting each of the floor plates to a final position on the vertical support core. A method for assembling one of the floor plates includes determining expected loads for the floor plate, and determining expected deflections for cantilevered portions of the floor plate based upon the expected loads. A floor plate frame is assembled near ground level, wherein the floor plate frame includes a plurality of framing members disposed on a plurality of girders. Cambers are imparted into each of the plurality of framing members based upon the expected deflections, and metal decking is installed onto the floor plate frame. A plurality of permanent support points for the floor plate are determined, wherein the floor plate is attachable to the vertical support core at the permanent support points. First pedestals are installed between ground level and the floor plate frame, wherein the plurality of first pedestals are disposed proximal to the permanent support points for the floor plate, and the first pedestals are controlled to lift the floor plate frame. Hardenable material is dispersed onto the metal decking of the floor plate frame while the floor plate frame is lifted at the permanent support points.

An aspect of the disclosure includes the plurality of permanent support points for the floor plate including elements disposed on the floor plate that are attachable to the vertical support core when the floor plate is lifted into a final location.

Another aspect of the disclosure includes installing, at key support points, a plurality of secondary pedestals between the ground level and the floor plate frame prior to the dispersing of the hardenable material onto the metal decking, and controlling vertical heights of the secondary pedestals based upon the imparted cambers of the plurality of the framing members of the floor plate frame.

Another aspect of the disclosure includes the secondary pedestals being attached to a base that is disposed on the ground level and attached to the floor plate frame at the key support points; and wherein the secondary pedestals are disposed to oppose upward and downward deflection of the floor plate frame at the key support points.

Another aspect of the disclosure includes the plurality of girders including first and second girders, wherein assembling the floor plate frame includes arranging the first and second girders in parallel on opposed sides of the vertical support core at ground level, and assembling each of a plurality of framing members to the first and second girders, wherein each of the framing members includes a medial beam attached to first and second cantilevered beams, wherein each of the framing members is arranged transverse to and supported by the first and second girders.

Another aspect of the disclosure includes the first and second girders each including a vertically-oriented web portion and a flange portion, wherein a plurality of apertures are disposed in the web portions of the first and second girders. Assembling each of the plurality of framing members to the first and second girders includes inserting a first end of the first cantilevered beam into one of the apertures of the first girder, inserting a first end of the second cantilevered beam into one of the apertures of the second girder, joining the first end of the first cantilevered beam to a first end of the medial beam at a first junction, securing the first junction of the medial beam and the first cantilevered beam at the first camber, joining the first end of the second cantilevered beam to a second end of the medial beam at a second junction, and securing the second junction of the medial beam and the second cantilevered beam at the second camber.

Another aspect of the disclosure includes determining expected deflections for the cantilevered portions of the floor plate based upon the expected loads, including determining an expected deflection for the first cantilevered beam and determining an expected deflection for the second cantilevered beam based upon the expected loads. This includes imparting vertical cambers into the plurality of framing members of the floor plate frame based upon the expected deflections, including setting a first camber between the medial beam and the first cantilevered beam based upon the expected deflection of the first cantilevered beam, and setting a second camber between the medial beam and the second cantilevered beam based upon the expected deflection of the second cantilevered beam.

Another aspect of the disclosure includes the first and second cambers being selected such that an upper planar surface of the floor plate forms a flat horizontal surface when the floor plate is fixedly attached to the vertical support core of the building.

Another aspect of the disclosure includes lifting the liftable floor plate upward on the vertical support core, and permanently affixing the liftable floor plate onto the vertical support core.

Another aspect of the disclosure includes installing the metal decking onto the floor plate frame onto a lower portion of the floor plate frame.

The above features and advantages and other features and advantages of the present teachings are readily apparent from the following detailed description of the best modes for carrying out the teachings when taken in connection with the accompanying drawings.

It should be understood that the appended drawings are not necessarily to scale, and present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some of these details. Moreover, for the purpose of clarity, certain technical material that is understood in the related art has not been described in detail in order to avoid unnecessarily obscuring the disclosure. Furthermore, the drawings are in simplified form and are not to precise scale. For purposes of convenience and clarity only, directional terms such as top, bottom, left, right, up, over, above, below, beneath, rear, and front, may be used with respect to the drawings. These and similar directional terms are not to be construed to limit the scope of the disclosure. Furthermore, the disclosure, as illustrated and described herein, may be practiced in the absence of an element that is not specifically disclosed herein. Those having ordinary skill in the art will recognize that terms such as "above," "below," "upward," "downward," "top," "bottom," etc., are used descriptively for the figures, and do not represent limitations on the scope of the disclosure, as defined by the appended claims.

Figure 1:
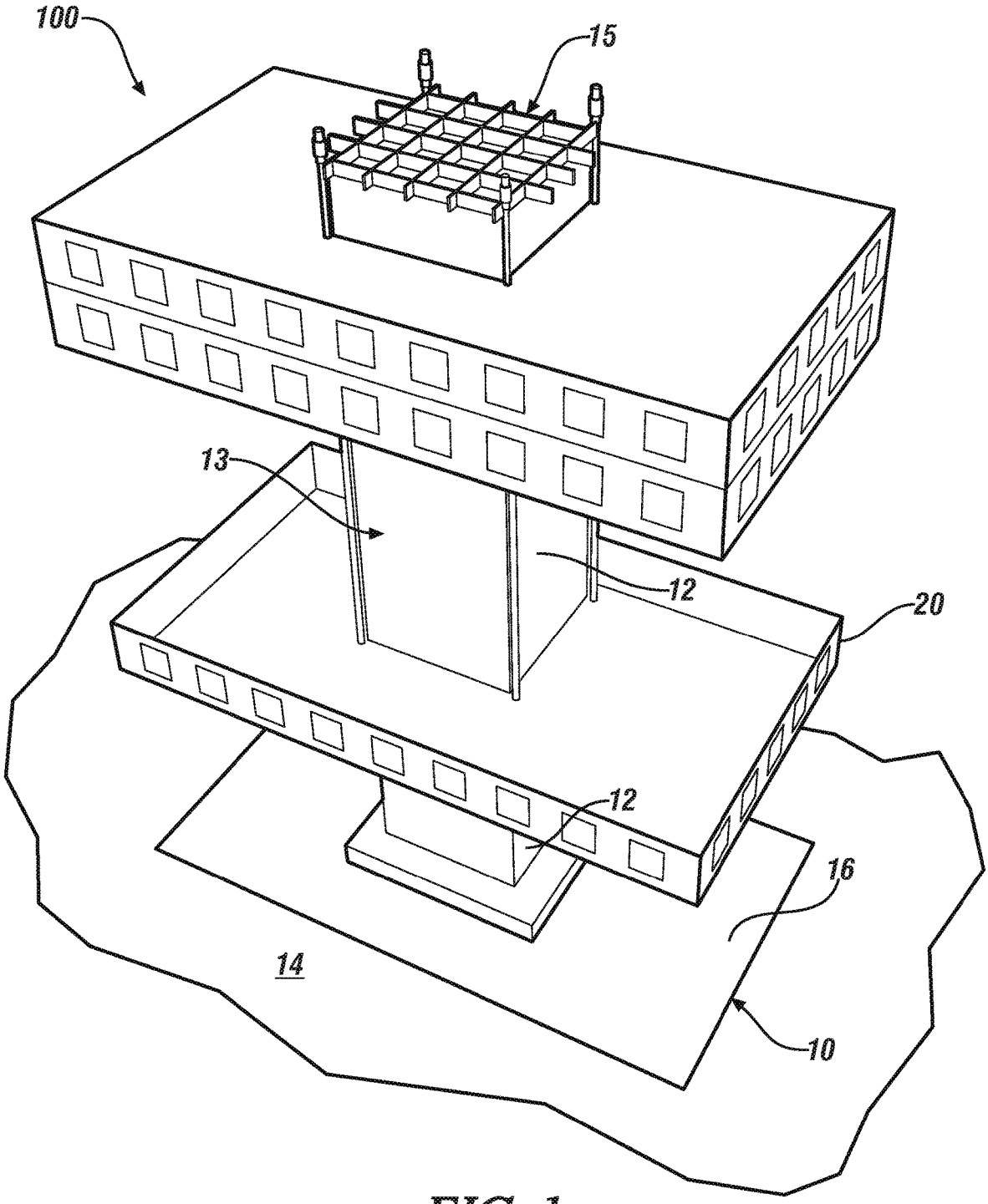
FIG. 1 is a schematic perspective view of a partially constructed building, in accordance with the disclosure.

Referring to the Figures, wherein like numerals indicate like parts throughout the several views, a construction system is generally shown at 10 in FIG. 1. The construction system 10 may be used to construct a building 100, and particularly a multi-story building 100. In general, the construction system 10 may be used to implement a top-down construction process, in which floor plates 20 are constructed at ground elevation 14, lifted to a respective final elevation, and attached to a vertical support core 12 of the building 100 in a descending, sequential order. The building 100 includes the vertical support core 12, which is assembled onto a foundation 11 as shown with reference to FIG. 2, and a plurality of the floor plates 20.

As used herein, the term "floor plate 20" includes all structural or frame members, e.g., joists and/or purlins, flooring, e.g., concrete floor, interior walls, exterior curtain walls, modular room subassemblies, e.g., a lavatory module, utilities, etc., that form a floor or level of the building 100. The term "floor plate 20" may include a plate for the roof structure of the building 100, as well as a plate for a floor or level of the building 100. Accordingly, it should be appreciated that the term "floor plate 20" is used herein to refer to both the roof structure for the roof of the building 100, as well as a floor structure for a floor or level of the building 100. As used herein and shown in the Figures, the reference numeral 20 may refer to and indicate any floor plate 20 of the building 100. The floor plate 20 specifically includes a floor plate frame 21, the fabrication of which is described herein.

The construction system 10 includes the vertical support core 12, which is an element of a vertical slip form system 13. The vertical slip form system 13 is operable to form the vertical support core 12 of the building 100 from a hardenable material 26 while moving vertically upward from the ground elevation 14 to a finished elevation. The hardenable material 26 may include, but is not limited to, a concrete mixture or other similar composition. The hardenable material 26 may include one or more additives to enhance one or more physical characteristics of the hardenable material 26, such as to reduce curing time, reduce slump, increase strength, etc. The specific type and contents of the hardenable material 26 may be dependent upon the specific application of the building 100, and may be dependent upon the specific geographic region in which the building 100 is being constructed. The specific type and contents of the hardenable material 26 are understood by those skilled in the art, are not pertinent to the teachings of this disclosure, and are therefore not described in greater detail herein.

The vertical support core 12 is designed to carry the vertical loads of the building 100. As such, the shape of the vertical support core 12 may be designed as necessary to provide the required compressive strength, shear strength, and bending strength for the particular application, size, and location of the building 100. It should be appreciated that the wall of the vertical support core 12 may be configured to include multiple load bearing columns connected by shear walls. In other embodiments, the wall of the vertical support core 12 may be designed to include a generally uniform construction around the entire perimeter of the vertical support core 12.

As shown in FIG. 1, the construction system 10 may further include one or a plurality of lifting device(s) 15 attached to the vertical support core 12, which may be used for raising the floor plates 20 relative to the vertical support core 12. For example, the lifting devices 15 may include, but are not limited to a plurality of strand jacks. However, the lifting devices 15 may include other devices capable of lifting each of the floor plates 20 of the building 100. The strand jacks grasp and move a cable to lift heavy objects. The specific features and operation of the strand jacks are known to those skilled in the art, are not pertinent to the teachings of this disclosure, and are therefore not described herein. The roof structure and each of the floor plates 20 may be assembled at ground elevation 14 and lifted into their respective final elevations relative to the vertical support core 12 in a sequential descending order employing the lifting devices 15.

The floor plates 20 make up discrete sections of the building 100. Each of the floor plates 20 is assembled a few feet above ground level and lifted to its design elevation employing one or more of the lifting devices 15 or other vertical conveyance structure(s), and permanently affixed to and supported by the vertical support core 12. The floor plates 20 are cantilevered from the lifting devices 15 and therefore, the weight of each of the floor plates 20 is best distributed symmetrically around the vertical support core 12 and the lifting devices 15. The floor plates 20 may be designed asymmetrically around the lifting devices 15 so long as proper design and loading techniques are utilized.

Figure 2:
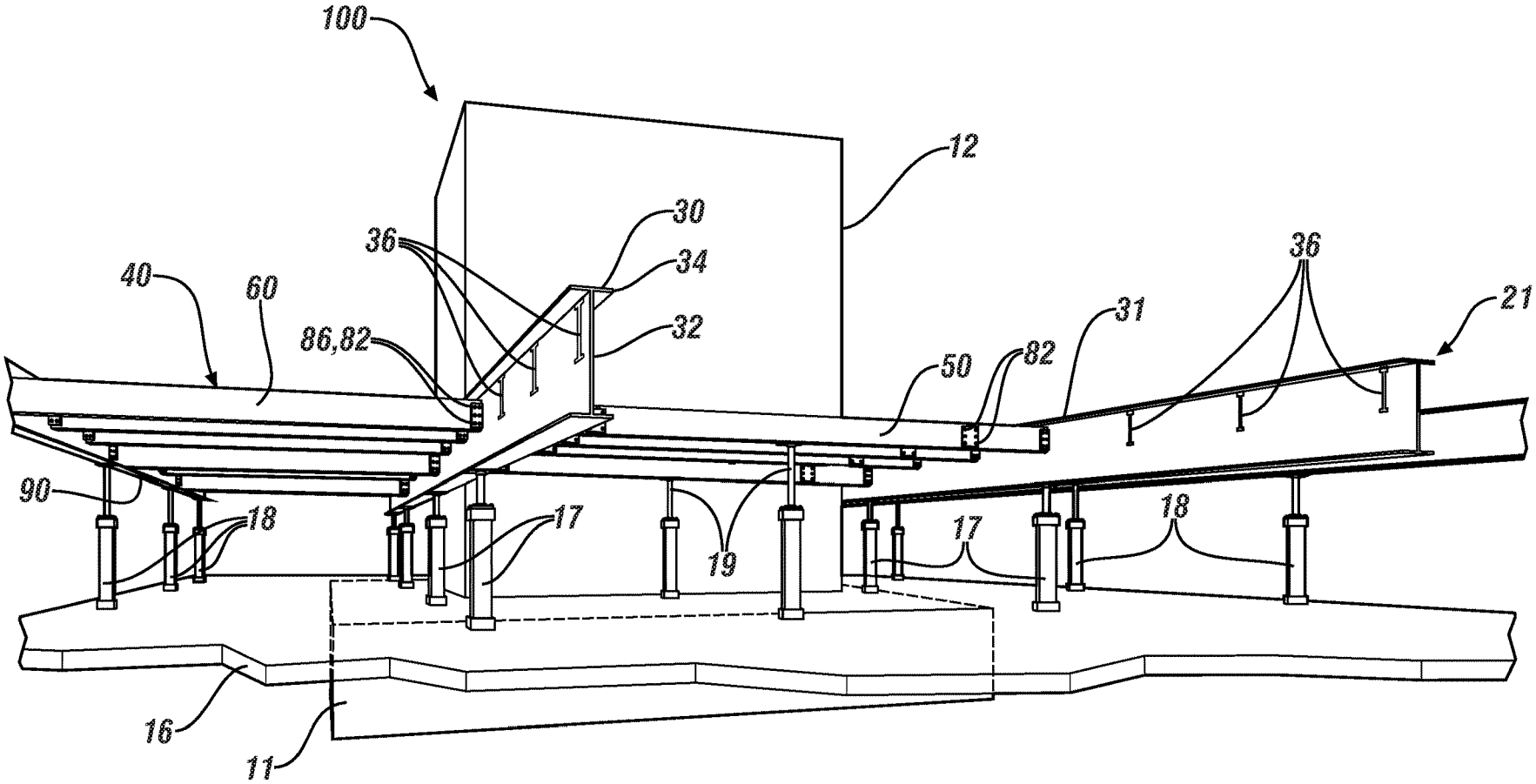
FIG. 2 is a schematic perspective view of elements of a floor plate and a vertical support core of a partially constructed building, in accordance with the disclosure.
Figure 3:
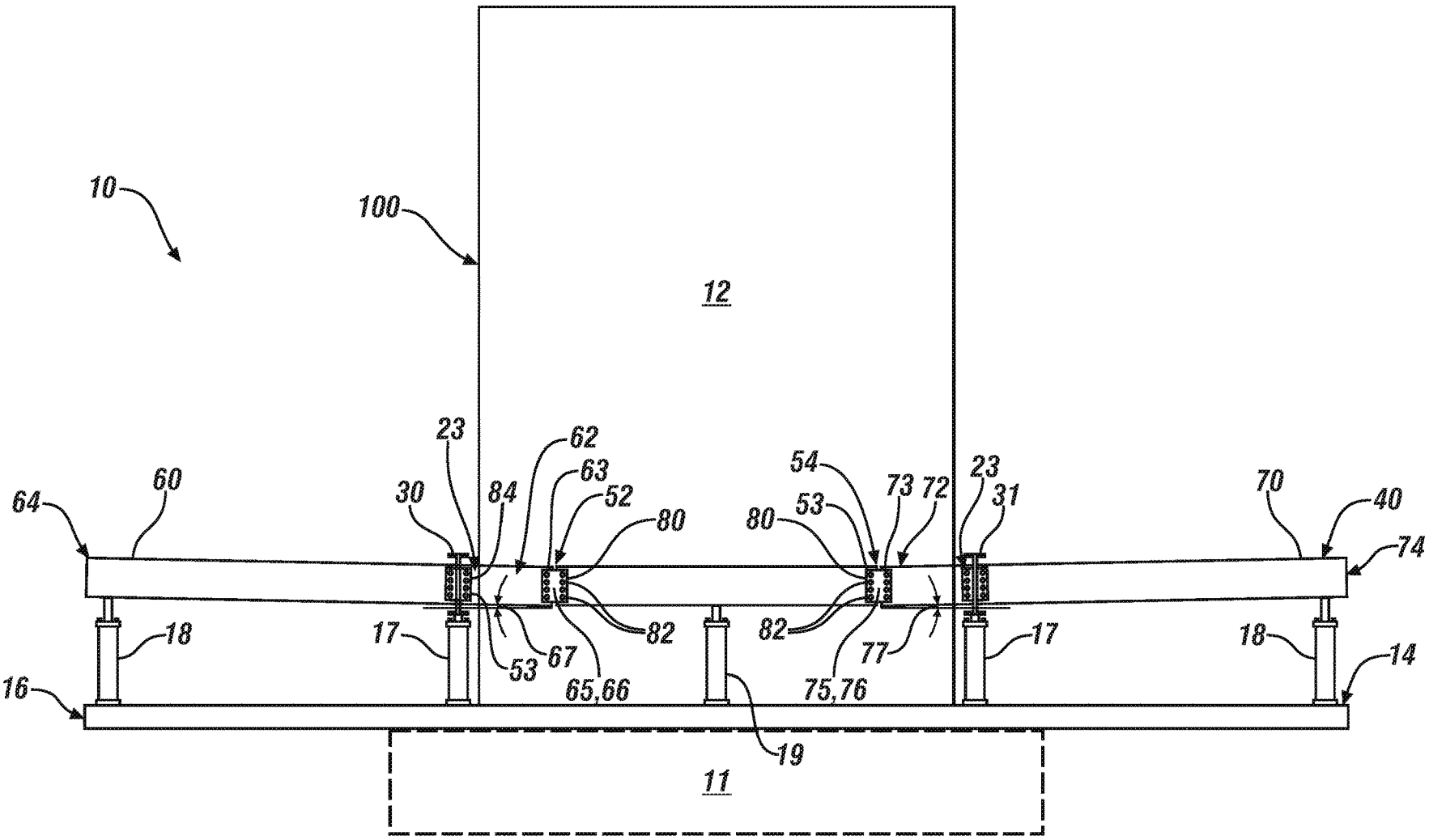
FIG. 3 is a schematic cross sectional side view of a floor plate and vertical support core of a partially constructed building in a supported arrangement during assembly, in accordance with the disclosure.
Figure 4:
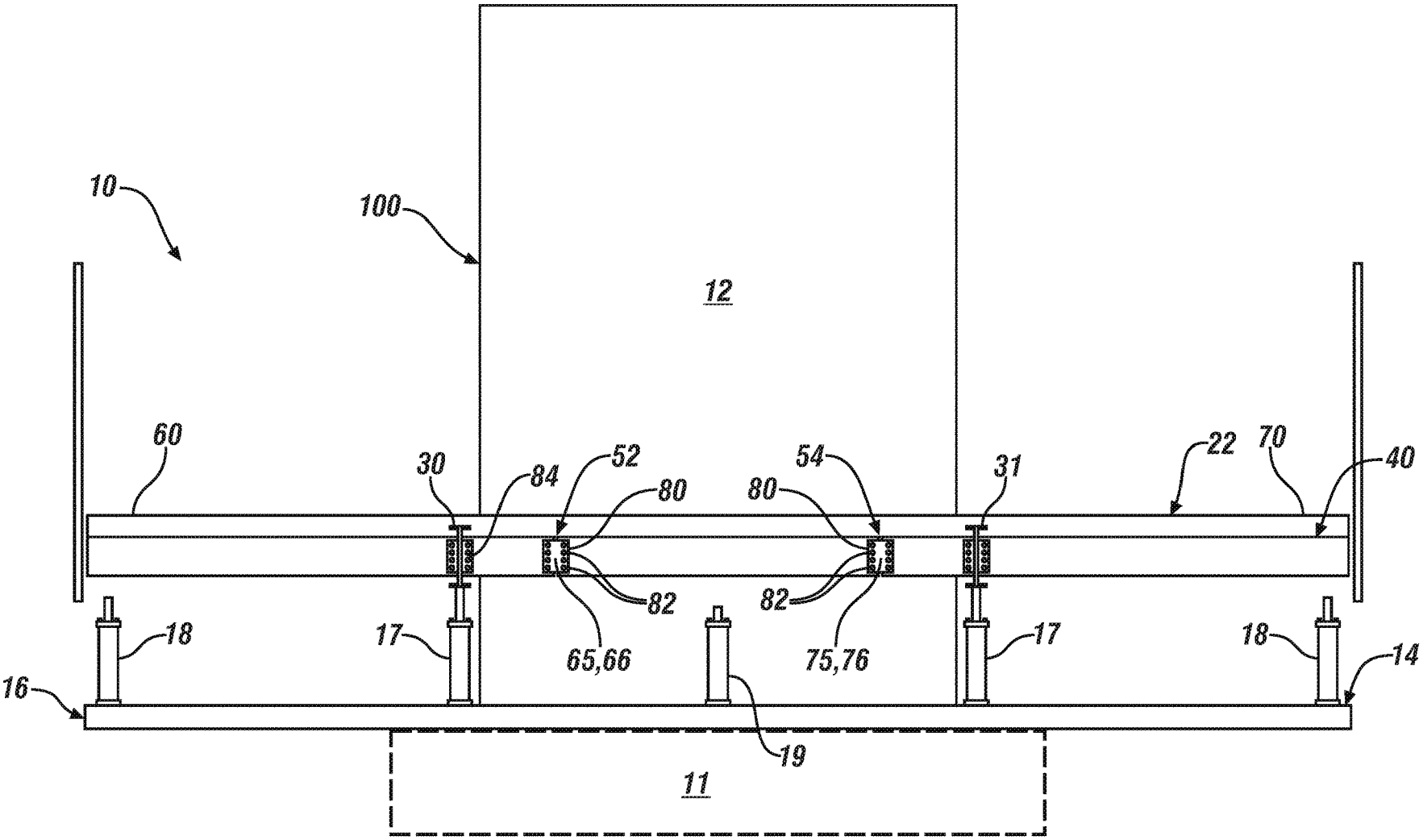
FIG. 4 is a schematic cross sectional side view of a floor plate and vertical support core of a partially constructed building in a suspended arrangement, in accordance with the disclosure.

As described herein with reference to FIGS. 2, 3, and 4, each of the floor plates 20 is assembled as a woven structure in the form of main framing members e.g., first and second girders 30, 31, a plurality of transversely-oriented continuous framing members 40, and in one embodiment, spandrels 90. The girders 30 run continuously between supports that may be attached to the lifting devices 15. The continuous framing members 40 penetrate the first and second girders 30, 31 and are supported at multiple points with preset cambers. Camber is defined as a deviation from a flat, level, horizontal plane. Each of the continuous framing members 40 is an assembled part that includes a medial beam 50 and first and second cantilevered beams 60, 70. This arrangement results in a floor assembly that is strong, and thus can be exploited to reduce beam depth without increasing vertical deflection. The woven structure-framed roof and floor plates impart precise amounts of camber at junctions. The junctions may be formed employing friction bolts and plates at inflection points to meet camber requirements. The combination of bolted, four-sided junctions together with the woven structure creates an efficient and flexible roof and floor plate structure that may be adjusted for camber control during assembly. The woven structure maximizes the strength of the transverse members, e.g., framing members 40, permitting beam depth to be minimized. Weight and overall depth of the floor plates 20 is thereby minimized. Furthermore, openings in first and second girders 30, 31 that permit the transverse beams to penetrate are cut to close tolerances, providing bracing at locations of penetrations. This bracing may prevent unintended rotation of the transverse members during assembly even before any junctions have been installed.

FIGS. 2, 3, 4 and 5 schematically show elements of an embodiment of the building 100, including portions of the floor plate 20 that is being assembled at ground elevation 14, and the vertical support core 12. The floor plate 20 includes first and second girders 30 that are arranged in parallel and slidably disposed on opposed sides of the vertical support core 12 in a manner that permits and facilitates vertical conveyance. Each of the first and second girders 30, 31 includes a vertically-oriented web portion 32 and a flange portion 34. The first and second girders 30, 31 may each be configured, by way of non-limiting examples as an I-beam, a C-beam, a T-beam, an L-beam, a square beam, a rectangular beam, etc., and are fabricated from steel in one embodiment. A plurality of apertures 36 are formed in the vertically-oriented web portions 32, and are configured to accommodate insertion of one of the first and second cantilevered beams 60, 70. The first and second girders 30, 31 are disposed on a plurality of first pedestals 17 that are disposed on an assembly pad 16, which is fabricated over the foundation 11.

A plurality of the continuous framing members 40 are disposed transverse to the first and second girders 30, 31. Each of the framing members 40 includes the medial beam 50 that is attached to the first and second cantilevered beams 60, 70, and is arranged transverse to and supported by the first and second girders 30, 31.

The medial beam 50 and the first and second cantilevered beams 60, 70 are each configured to have a flat beam section on a top portion of the respective beam along its longitudinal axis. The medial beam 50 may be configured as an I-beam, a C-beam, a T-beam, an L-beam, a square beam, a rectangular beam, etc., which defines a respective cross-sectional shape. The medial beam 50 includes first and second ends 52, 54, respectively, with a plurality of bolt through-holes 53 disposed thereat.

Each of the first and second cantilevered beams 60, 70 may be an I-beam, a C-beam, a T-beam, an L-beam, a square beam, a rectangular beam, etc., which defines a respective cross-sectional shape. The cross-sectional shape associated with the first cantilevered beam 60 corresponds to the respective aperture 36 in the first girder 30, and the cross-sectional shape associated with the second cantilevered beam 70 corresponds to the respective aperture 36 in the second girder 31. Each of the first cantilevered beams 60 includes first and second ends 62, 64, respectively, with a plurality of bolt through-holes 63 disposed thereat. Each of the second cantilevered beams 70 includes first and second ends 72, 74, respectively, with a plurality of bolt through-holes 73 disposed thereat. The medial beams 50 are horizontally disposed between the first and second girders 30, 31. The length of each of the medial beams 50 is selected to define inflection points, including a first inflection point 66 and a second inflection point 76.

The first end 62 of each of the first cantilevered beams 60 is threaded through one of the apertures 36 of the first girder 30 and is attached to the first end 52 of the respective medial beam 50 at a first junction 65, which defines a first inflection point 66 that has a first camber 67. The first end 62 the first cantilevered beam 60 is attached to the first end 52 of the respective medial beam 50 employing span plates 80 and friction bolts 82 via respective bolt through-holes 53 and bolt through-holes 63. The first cantilevered beam 60 is also attached to the first girder 30 mid-span employing angle plates 84 and friction bolts 82 via other bolt through-holes 86. The second ends 64 of the first cantilevered beams 60 are attached to a spandrel 90 in one embodiment.

The first end 72 of each of the second cantilevered beams 70 is threaded through one of the apertures 36 of the second girder 31 and is attached to the second end 54 of the respective medial beam 50 at a second junction 75, which defines a second inflection point 76 that has a second camber 77. The first end 72 of the second cantilevered beam 70 is attached to the second end 54 of the respective medial beam 50 employing span plates 80 and friction bolts 82 via respective bolt through-holes 53 and bolt through-holes 63. The second cantilevered beam 70 is also attached to the first girder 30 mid-span employing angle plates 84 and friction bolts 82 via other bolt through-holes. The second ends 74 of the second cantilevered beams 70 are attached to another spandrel 90.

The first and second cambers 67, 77 are selected such that an upper planar surface 22 of the floor plate 20 forms a flat horizontal surface when the floor plate 20 is fixedly attached to the vertical support core 12. The first inflection point 66 is defined for each of the continuous framing members 40 at the first junction 65 between the first end 62 of the first cantilevered beams 60 attached to the first end 51 of the medial beam 50, with the associated first camber 67. Likewise, the second inflection point 76 is defined at the second junction 75 between the first end 72 of the second cantilevered beam 70 attached to the second end 54 of the medial beam 50, with the associated second camber 77.

The bolt through-holes 53 of the medial beam 50, and/or the bolt through-holes 63 of the respective first ends 62, 72 of the first and second cantilevered beams 60, 70, respectively, may be slightly enlarged to allow play in the respective first and second junctions 65, 75. As such, the first and second junctions 65, 75 permit pivoting of the first and second cantilevered beams 60, 70 at the respective inflection points 66, 76, which can be employed to impart and adjust the first and second cambers 67, 77. This arrangement facilitates camber control and adjustment to achieve flatness of each of the floor plates 20 during construction. This arrangement permits adjustment of the final geometry of the floor plate 20 during fabrication to achieve a desired camber requirement prior to tightening of the friction bolts 82.

Prior to fabrication of one of the floor plates 20, each previously constructed, lifted and permanently supported one of the floor plates 20 is analyzed for deflection as part of the design process. Anticipated deflection values for each of the completed plates in its permanently supported configuration are plotted for key points on the structural frame. The purpose is to allow each roof and floor plate to achieve a flat, level geometry in its final connected condition.

Prior to tightening the friction bolts 82 at the first and second junctions 65, 75, elements of the floor plate frame 21 may be adjusted to achieve the designed deflection values at key points. Shims may be installed at fixed pedestals, or the required values may be input into a control system of a network of first, second and third pedestals 17, 18, and 19, respectively, to impart the desired camber. Once the desired camber values have been achieved, the friction bolts 82 can be tightened to secure the first and second junctions 65, 75. Alternatively, or in addition, the first and second junctions 65, 75 may be secured by welding the span plates 80 to the respective ones of the first and second cantilevered beams 60, 70 and the medial beam 50.

The floor plate frame 21 may be lifted by the first pedestals 17 at locations that are proximal to the permanent support points 23, and additional ones of the second and third pedestals 18, 19 may be installed as required to maintain the required geometry during placement and curing of the hardenable material 26. As each floor plate 20 is installed in its final connected condition, field measurements of flatness may be taken. Additional adjustments to camber may be made through the adjustment of the imparted camber junctions to improve flatness tolerances of each successively installed floor plate.

The first, second and third pedestals 17, 18, 19 may include two-way hydraulic cylinders that are connected to the assembly pad 16 and connected to the portion of the floor plate 20 being supported. The use of two-way hydraulic cylinders, or an equivalent device, permits control of the first, second and third pedestals 17, 18, 19 to induce tension force or compressive force on the affected portion of the floor plate frame 21. As such, each of the first, second and third pedestals 17, 18, 19 may push upward on the affected portion of the floor plate frame 21 or pull downward on the portion of the floor plate frame 21 to achieve a desired camber and flatness during fabrication. The first, second and third pedestals 17, 18, 19 may be computer-controlled hydraulic pedestals that provide the capability to make in-field height adjustments to adjust camber, which in turn facilitates the achievement a high degree of floor flatness. The hydraulic pedestals move, i.e., vertically adjust the floor plate frame 21 to the desired right camber position before the hardenable material 26 has cured, and holds the floor plate assembly 21 in position during curing in order to achieve desired flatness. This operation facilitates shaping the floor plate 20 while it is being fabricated and while the hardenable material is being poured by making in-process adjustments. Flatness can be monitored and adjusted while the hardenable material is being poured and during curing.

As each of the floor plates 20 is lifted and locked in to its permanently supported condition at its design elevation, the achieved flatness is measured and outcomes may be used to adjust the geometry of the next one of the floor plates 20 being fabricated. This process improves the flatness tolerance of each successive floor plate.

The building 100 employs cantilevered floor plates for roof and floor plate framing. The roof and floor plate assemblies have progressing conditions of loading and deflection throughout fabrication, lifting to final elevation, permanent connection to the vertical slip form system 13, application of service loads, and similar conditions encountered during construction and use. Consequently, the structural engineering process incorporates these multiple and varying conditions into the design of the structural system, along with consideration of appropriate tolerances for other elements, including but not limited to building envelope, interior partitions, mechanical and electrical systems, live loads, etc.

The camber of each of the floor plates 20 in its final connected condition is determined by engineering calculation, resulting in a final deflection value from true level at key points along the structural frame. The camber required for the floor plate 20 can then be set so that it will achieve a flat, level configuration in its final connected condition.

As each floor is installed in its final connected condition, field measurements of flatness are taken. Additional adjustments to camber may be made through the adjustment of the imparted camber connections to improve flatness tolerances of each successively installed floor plate.

FIG. 3 schematically shows a side view of the building 100 with the floor plate 20 in a supported arrangement, i.e., with first pedestals 17 arranged to support the floor plate 20 at the first and second girders 30, 31, and with second pedestals 18 and third pedestals 19 arranged to support the first cantilevered beam 60 to achieve the first camber 67 at the first inflection point 66 as defined by the first junction 65, and also arranged to support the second cantilevered beam 70 to achieve the second camber 77 at the second inflection point 76 as defined by the second junction 75. This is shown prior to any hardenable material 26 being disposed thereon. The second and third pedestals 18, 19 are also referred to herein as "secondary pedestals".

FIG. 4 schematically shows a side view of the building 100 with the floor plate 20 in a suspended arrangement, i.e., with only the first pedestals 17 supporting the first and second girders 30, 31 of the floor plate frame 21 proximal to the permanent support points 23, and with hardenable material 26 disposed thereon and forming an upper planar surface 22.

Figure 5:
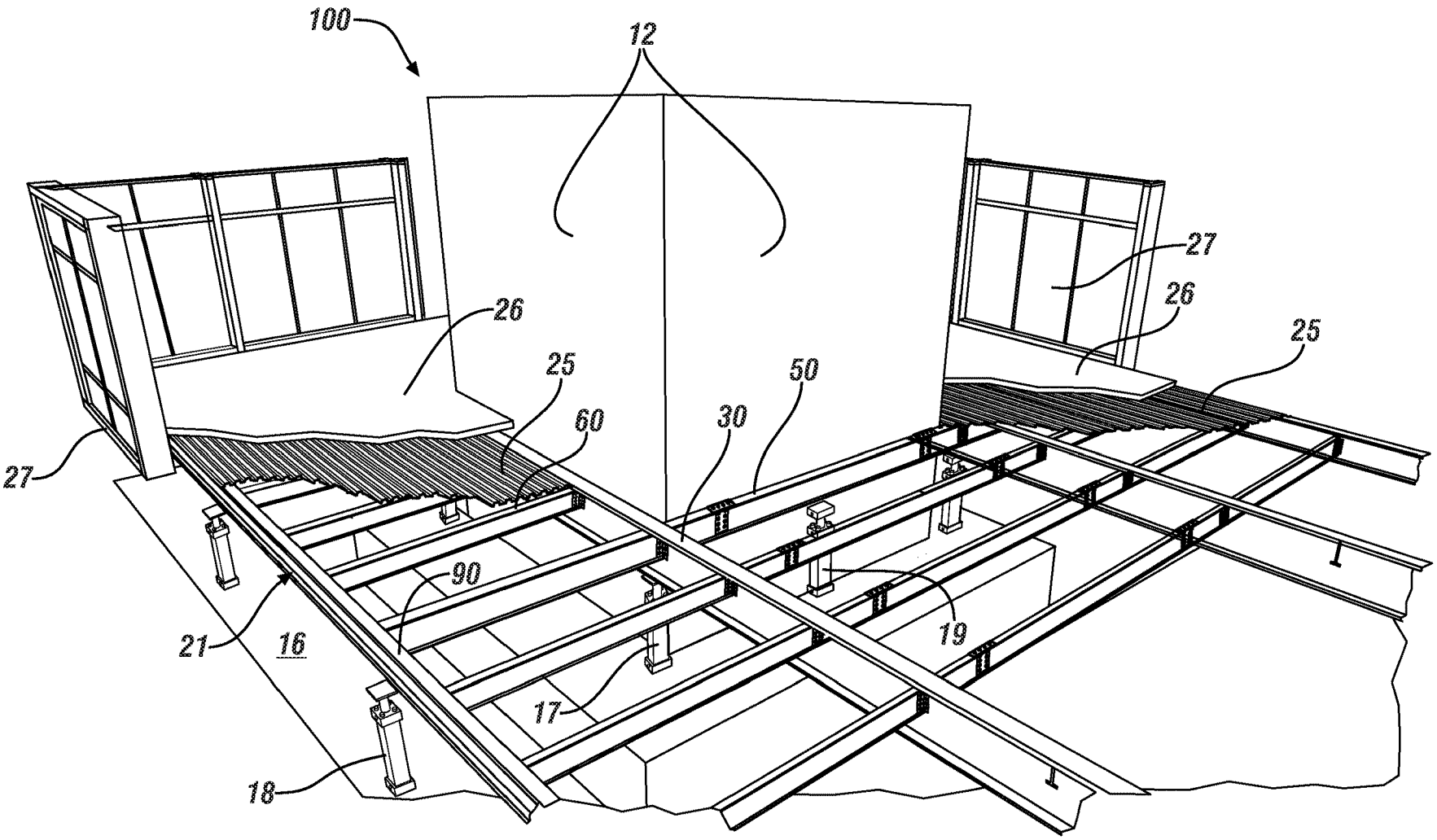
FIG. 5 is a schematic perspective view of elements of a partially constructed building, including a floor plate including metal decking, and a vertical support core, in accordance with the disclosure.

FIG. 5 schematically shows a perspective view of the building 100 with the floor plate 20 that is partially assembled, including metal decking 25 that is attached onto an underside portion of the floor plate frame 21. The metal decking 25 provides a lower plate on which hardenable material 26, indicated by numeral 27, can be poured during fabrication. This approach to assembling the floor plate 20 may achieve improved surface flatness tolerances by facilitating the accurate simulation of each floor plate's permanent support condition during grade-level fabrication.

The members of the floor plate frame 21 are set on hydraulic pedestals with pre-designed cambers. Once the hardenable material 26 has been placed on the metal decking 25 that is attached to the floor plate frame 21, the entire floor plate 20 becomes rigid. As it is placed, the weight of the hardenable material 26 is properly supported, and the methodology used and location points of supports during concreting operations may be helpful in achieving an acceptable outcome. The supported points are proximal to the final locked-in condition to avoid variations in floor flatness throughout the floor plate assembly once it is permanently supported. Hardenable material 26 is placed and cured while the floor plate frame 21 is supported only at its permanent support points by the lifting provided with the vertical conveyance structure 13. The floor plate 20 is expected to achieve its final geometry prior to being lifted to its final elevation. Before the weight of hardenable material 26 is added to the floor plate frame 21, additional second and third pedestals 18, 19 may be installed in key locations, with heights being computer-controlled. Movement is possible in both up and down direction. All of the first, second and third pedestals 17, 18, 19 can be adjusted simultaneously to move the entire floor plate 20 or adjusted individually control of camber. Hydraulic pedestals may be used to raise and lower the entire floor plate 20, within the pedestal's range of movement, while still maintaining a unique geometry without variation. This movement capability may facilitate worker access to various portions of the structural frame for fabrication, the on-loading of delivered materials and equipment to the roof or floor plate, and the off-loading of debris and waste materials from the roof or floor plate.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

The invention claimed is:

1. A method for assembling a floor plate to a multi-story building that includes a vertical support core, the method comprising:

determining expected loads for the floor plate;

determining expected deflections for cantilevered portions of the floor plate based upon the expected loads;

assembling a floor plate frame near ground level, wherein the floor plate frame includes a plurality of framing members disposed on a plurality of girders;

imparting cambers into the plurality of framing members of the floor plate frame based upon the expected deflections;

installing metal decking onto the floor plate frame;

determining a plurality of permanent support points for the floor plate, wherein the floor plate is attached to the vertical support core at the permanent support points;

installing a plurality of first pedestals between the ground level and the floor plate frame, wherein the plurality of first pedestals are disposed to support the floor plate frame proximal to the permanent support points;

lifting, via the first pedestals, the floor plate frame;

installing, at key support points, a plurality of secondary pedestals between the ground level and the floor plate frame, wherein the secondary pedestals are attached to a base that is disposed on the ground level and attached to the floor plate frame at the key support points; and wherein the secondary pedestals are disposed to oppose upward and downward deflection of the floor plate frame at the key support points;

controlling vertical heights of the secondary pedestals based upon the cambers of the plurality of the framing members of the floor plate frame; and dispersing hardenable material onto the metal decking of the floor plate frame.

2. The method of claim 1, wherein the plurality of permanent support points for the floor plate comprises elements disposed on the floor plate that are attachable to the vertical support core when the floor plate is lifted into a final location.

3. The method of claim 1, further comprising:

vertically lifting the floor plate to a desired position on the vertical support core; and securing the floor plate to the vertical support core at the plurality of permanent support points.

4. The method of claim 1, wherein the plurality of girders includes a first and second girder; and wherein assembling the floor plate frame comprises:

arranging the first and the second girders in parallel on opposed sides of the vertical support core at ground level; and assembling each of the plurality of framing members to the first and second girders, wherein each of the framing members includes a medial beam attached to first and second cantilevered beams, wherein each of the framing members is arranged transverse to and supported by the first and second girders.

5. The method of claim 4, wherein the first and second girders each includes a vertically-oriented web portion and a flange portion, wherein a plurality of apertures are disposed in the web portions of the first and second girders; and wherein assembling each of the plurality of framing members to the first and second girders comprises:

inserting a first end of the first cantilevered beam into one of the apertures of the first girder;

inserting a first end of the second cantilevered beam into one of the apertures of the second girder;

joining the first end of the first cantilevered beam to a first end of the medial beam at a first junction, securing the first junction of the medial beam and the first cantilevered beam at a first of the cambers;

joining the first end of the second cantilevered beam to a second end of the medial beam at a second junction, and securing the second junction of the medial beam and the second cantilevered beam at a second of the cambers.

6. The method of claim 5, wherein determining expected deflections for the cantilevered portions of the floor plate based upon the expected loads comprises determining a first expected deflection for the first cantilevered beam and determining a second expected deflection for the second cantilevered beam based upon the expected loads; and wherein imparting the cambers into the plurality of framing members of the floor plate frame based upon the expected deflections comprises:

setting the first of the cambers between the medial beam and the first cantilevered beam based upon the first expected deflection of the first cantilevered beam, and setting the second of the cambers between the medial beam and the second cantilevered beam based upon the second expected deflection of the second cantilevered beam.

7. The method of claim 6, wherein the first and second cambers are selected such that an upper planar surface of the floor plate forms a flat horizontal surface when the floor plate is fixedly attached to the vertical support core of the building.

8. The method of claim 1, further comprising:

lifting the floor plate upward on the vertical support core; and permanently affixing the floor plate onto the vertical support core.

9. The method of claim 1, wherein installing the metal decking onto the floor plate frame comprises installing the metal decking onto a lower portion of the floor plate frame.

10. A method for assembling a floor plate for a multi-story building, the method comprising:

determining expected loads for the floor plate;

determining expected deflections for cantilevered portions of the floor plate based upon the expected loads;

assembling a floor plate frame on a base, wherein the floor plate frame includes a plurality of framing members disposed on a plurality of girders;

imparting cambers into the plurality of framing members of the floor plate frame based upon the expected deflections;

installing metal decking onto the floor plate frame;

determining a plurality of permanent support points for the floor plate;

installing a plurality of first pedestals between the base and the floor plate frame, wherein the plurality of first pedestals are disposed to support the floor plate frame proximal to the permanent support points;

installing, at key support points, a plurality of secondary pedestals between the base and the floor plate frame, wherein the secondary pedestals are attached to the base and attached to the floor plate frame at the key support points; and wherein the secondary pedestals are disposed to oppose upward and downward deflection of the floor plate frame at the key support points;

controlling vertical heights of the secondary pedestals based upon the cambers of the plurality of the framing members of the floor plate frame;

lifting, via the first pedestals, the floor plate frame; and dispersing hardenable material onto the metal decking of the floor plate frame.

11. The method of claim 10, wherein the plurality of permanent support points for the floor plate comprises elements disposed on the floor plate that are attachable to a vertical support core when the floor plate is lifted into a final location.

12. The method of claim 10, wherein the plurality of girders includes a first and second girder; and wherein assembling the floor plate frame comprises:

arranging first and second girders in parallel on opposed sides of a vertical support core at ground level; and assembling each of a plurality of framing members to the first and second girders, wherein each of the framing members includes a medial beam attached to first and second cantilevered beams, wherein each of the framing members is arranged transverse to and supported by the first and second girders.

13. The method of claim 12, wherein the first and second girders each includes a vertically-oriented web portion and a flange portion, wherein a plurality of apertures are disposed in the web portions of the first and second girders; and wherein assembling each of the plurality of framing members to the first and second girders comprises:

inserting a first end of the first cantilevered beam into one of the apertures of the first girder;

inserting a first end of the second cantilevered beam into one of the apertures of the second girder;

joining the first end of the first cantilevered beam to a first end of the medial beam at a first junction, securing the first junction of the medial beam and the first cantilevered beam at the first camber;

joining the first end of the second cantilevered beam to a second end of the medial beam at a second junction, and securing the second junction of the medial beam and the second cantilevered beam at the second camber.

14. The method of claim 10, wherein determining expected deflections for the cantilevered portions of the floor plate based upon the expected loads comprises determining an expected deflection for a first cantilevered beam and determining an expected deflection for a second cantilevered beam based upon the expected loads; and wherein imparting the cambers into the plurality of framing members of the floor plate frame based upon the expected deflections comprises:

setting a first camber between the medial beam and the first cantilevered beam based upon the expected deflection of the first cantilevered beam, and setting a second camber between the medial beam and the second cantilevered beam based upon the expected deflection of the second cantilevered beam.

15. The method of claim 10, wherein installing the metal decking onto the floor plate frame comprises installing the metal decking onto a lower portion of the floor plate frame.

16. A liftable floor plate, comprising:

a floor plate frame, including:

first and second girders arranged in parallel and slidably disposed on opposed sides of a vertical support core of a multi-story building, a plurality of framing members, wherein each of the framing members includes a medial beam attached to first and second cantilevered beams, and wherein each framing member is arranged transverse to the first and second girders and supported by the first and the second girders;

metal decking;

hardenable material; and a plurality of permanent support points;

wherein each of the medial beams of each of the framing members is disposed between the first and second girders;

wherein each of the first cantilevered beams includes a first end and a second end;

wherein each of the second cantilevered beams includes a first end and a second end;

wherein the first end of each of the first cantilevered beams is joined to the first end of the respective medial beam at a first junction, wherein the first cantilevered beam and the medial beam define a first camber;

wherein the first end of each of the second cantilevered beams is joined to the second end of the respective medial beam at a second junction, wherein the second cantilevered beam and the medial beam define a second camber; and wherein the first and second cambers are selected to achieve a flat horizontal surface on an upper surface of the floor plate when the floor plate is fixedly attached to the vertical support core;

wherein the metal decking is attached to an underside portion of the floor plate frame;

wherein the floor plate frame is supported on a plurality of first pedestals that are disposed proximal to the permanent support points during dispersal of the hardenable material onto the metal decking of the floor plate frame.

17. The building of claim 16, further comprising a plurality of spandrels, wherein the spandrels are transverse to and attached to the second ends of the first and second cantilevered beams.

18. The building of claim 16, wherein each of the first and second girders comprises one of an I-beam, a C-beam, a T-beam, an L-beam, a square beam, or a rectangular beam.

19. The building of claim 16, wherein the first and second cambers are adjustable in-situ.

20. The building of claim 16, wherein the floor plate comprises a roof section of the building.

21. The building of claim 16, wherein the floor plate comprises a floor section of the building.

* * * * *